US012637919B2

(12) United States Patent
Morrison

(10) Patent No.: US 12,637,919 B2
(45) **Date of Patent: *May 26, 2026**

(54) FIXED-VOLUME SETTING TOOL

(71) Applicant: DBK Industries, LLC, Crowley, TX (US)

(72) Inventor: Jeremy Todd Morrison, Pickton, TX (US)

(73) Assignee: DBK INDUSTRIES, LLC, Crowley, TX (US)

( * ) Notice: Subject to any disclaimer, the term of this patent is extended or adjusted under 35 U.S.C. 154(b) by 3 days.

This patent is subject to a terminal disclaimer.

(21) Appl. No.: 18/934,694

(22) Filed: Nov. 1, 2024

(65) Prior Publication Data

US 2025/0059843 A1 Feb. 20, 2025

Related U.S. Application Data

(63) Continuation of application No. 18/134,411, filed on Apr. 13, 2023, now Pat. No. 12,139,984.

(60) Provisional application No. 63/331,603, filed on Apr. 15, 2022.

(51) Int. Cl.

| | |
|---|---|
| ***E21B 23/08*** | (2006.01) |
| ***E21B 17/042*** | (2006.01) |
| ***E21B 23/06*** | (2006.01) |
| ***E21B 43/1185*** | (2006.01) |
| ***E21B 43/26*** | (2006.01) |

(52) U.S. Cl.
CPC ..... *E21B 23/08* (2013.01); *E21B 17/042* (2013.01); *E21B 23/065* (2013.01); *E21B 43/11852* (2013.01); *E21B 43/261* (2013.01)

(58) Field of Classification Search
CPC ..... E21B 43/1185; E21B 23/065
See application file for complete search history.

(56) References Cited

U.S. PATENT DOCUMENTS

| | | | | |
|---|---|---|---|---|
| 9,598,492 | B2 | 3/2017 | Wells et al. | |
| 9,810,035 | B1 * | 11/2017 | Carr | E21B 23/065 |
| 10,472,939 | B2 | 11/2019 | Sullivan | |
| 11,053,783 | B2 | 7/2021 | Montoya Ashton et al. | |
| 2020/0018132 | A1 * | 1/2020 | Ham | E21B 33/1292 |
| 2020/0362652 | A1 * | 11/2020 | Eitschberger | E21B 23/04 |

* cited by examiner

*Primary Examiner* — Yanick A Akaragwe
(74) *Attorney, Agent, or Firm* — Johnston IP Law, PLLC

(57) ABSTRACT

A gas-operated, fixed-volume, downhole setting tool includes a mandrel having an upper portion and a lower portion. The mandrel has a first end on the upper portion and a second end on the lower portion. The mandrel also includes an interior combustion chamber having a first end proximate to the first end of the mandrel and having an interior upper portion. The setting tool further includes a pressure bulkhead with a pressure igniter disposed in the mandrel at the first end of the mandrel in the interior upper portion of the mandrel. The pressure igniter is sealed to at least a first threshold pressure. The pressure bulkhead and pressure igniter form a seal on the first end of the mandrel and thereby define a fixed volume for combustion gases. Other settings tools and assemblies are presented.

19 Claims, 12 Drawing Sheets

FIXED-VOLUME SETTING TOOL

RELATED APPLICATION

This application is a Continuation of U.S. application Ser. No. 18/134,411 filed Apr. 13, 2023, which claims the benefit of U.S. Provisional Patent Application No. 63/331,603, filed on Apr. 15, 2022, entitled, "Setting Tool with Fixed Volume Combustion Chamber," the disclosures of which are hereby incorporated by reference for all purposes.

TECHNICAL FIELD

This application is directed, in general, to downhole oil tools, and more specifically, to downhole fixed-volume setting tools for setting frac plugs, bridge plugs, and packers for sealing well casings.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas wells are drilled into earth formations by first creating a borehole and then running and cementing casing in the borehole. Well tools such as bridge plugs, packers, cement retainers, and frac plugs are often run into cased wells and set using setting tools powered by flammable power charges. Conventional well tools providing well casing sealing assemblies typically include a packer having one or more elastomeric sealing elements that are squeezed between a packer mandrel and the casing. They are held in place by one or more slip assemblies that are wedged between conical sleeves of the packers and the casing. The packers are configured for use as bridge plugs, tubing packers, cement retainers, and frac plugs. Improvements in the application of well casing sealing assemblies remain desirable.

SUMMARY

According to an illustrative embodiment, a gas-operated, fixed-volume, downhole setting tool includes a mandrel having an upper portion and a lower portion and a barrel piston having a first end and a second end. The barrel piston extends over at least a portion of the mandrel when in an in-line configuration and releasably coupled in a relative position to the mandrel when in the in-line configuration. The mandrel has a first end on the upper portion and a second end on the lower portion. The mandrel also includes an interior combustion chamber having a first end proximate to the first end of the mandrel and having an interior upper portion. The setting tool further includes a pressure bulkhead disposed in the mandrel at the first end of the mandrel in the interior upper portion of the mandrel and a pressure igniter coupled in the pressure bulkhead having an ignition control end and an ignition distribution end. The pressure igniter is sealed to at least a first threshold pressure. The pressure bulkhead and pressure igniter form a seal on the first end of the mandrel and thereby define a fixed volume for combustion gases.

According to another illustrative embodiment, a bottom hole assembly includes fracturing gun for perforating a well and a setting tool. The fracturing gun includes an upper end and a lower end. The setting tool includes an upper end and a lower end and further includes a mandrel having an upper portion and a lower portion and a barrel piston having a first end and a second end. The barrel piston is disposed proximate the mandrel when in an in-line configuration and releasably coupled in a relative position to the mandrel when in the in-line configuration.

The mandrel has a first end on the upper portion of the mandrel and a second end on the lower portion of the mandrel. The mandrel includes an interior combustion chamber having a first end and a second end, and further having an upper interior portion. The setting tool also includes a pressure bulkhead disposed in the upper interior portion of the mandrel, and a pressure igniter coupled in the pressure bulkhead having an ignition control end and an ignition distribution end. The pressure igniter is sealed to at least a first threshold pressure. The pressure bulkhead and pressure igniter form a seal on the first end of the mandrel and thereby define a fixed volume for combustion gases.

The bottom hole assembly further includes a rig-up adapter having an upper end and a lower end. The rig-up adapter is sized and configured at the lower end of the rig-up adapter to at least partially surround the upper end of the setting tool and is coupled by threads to the setting tool. The upper end of the rig-up adapter is sized and configured to extend into and mate with the lower end of the fracturing gun or another adapter and couple thereto.

According to still another illustrative embodiment, a bottom hole assembly includes a fracturing gun for perforating a well and a setting tool. The fracturing gun includes an upper end and a lower end. The setting tool has an upper end and a lower end. The upper end of the setting tool is sized and configured to mate and couple with the lower end of the fracturing gun. The setting tool includes a mandrel having an upper portion and a lower portion and a barrel piston having a first end and a second end. The barrel piston is disposed proximate to the mandrel when in an in-line configuration and releasably coupled in a relative position to the mandrel when in the in-line configuration.

The mandrel has a first end on the upper portion of the mandrel and a second end on the lower portion of the mandrel. The mandrel includes an interior combustion chamber having an upper end and a lower end. The mandrel further includes an upper interior portion. The setting tool also has a pressure bulkhead disposed in the upper interior portion of the mandrel and a pressure igniter coupled in the pressure bulkhead. The pressure igniter includes an ignition control end and an ignition distribution end. The pressure igniter is sealed to at least a first threshold pressure. The pressure bulkhead and pressure igniter form a seal on the first end of the mandrel and thereby define a fixed volume for combustion gases. The upper end of the setting tool may couple without an adapter to the perforating gun. Other embodiments are presented further below.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

A fracking example is provided for context, but other applications may apply. In the fracking process, after a horizontal well is drilled and cased, perforating guns conveyed on coiled tubing or stick pipe are fired in the horizontal section of the well. Once the perforated guns are fired and pulled out, the first stage is fractured. After that, it is desirable to isolate an upstream portion—above the previously perforated portion—and this is done by placing a frac plug. The frac plug with a setting tool is conveyed into the well as part of a bottom hole assembly (BHA) to the desired depth. On depth, the firing head is activated by an electrical current from a wireline truck that activates an igniter to then cause the power charge in a setting tool to activate. That in turn motivates movement of a barrel piston to do a full and complete stroke, which causes the setting tool to disconnect from the frac plug. In this process, the frac plug is sealed in the casing. The second zone is then treated and so forth until all the zones are perforated as desired.

Figure 1:
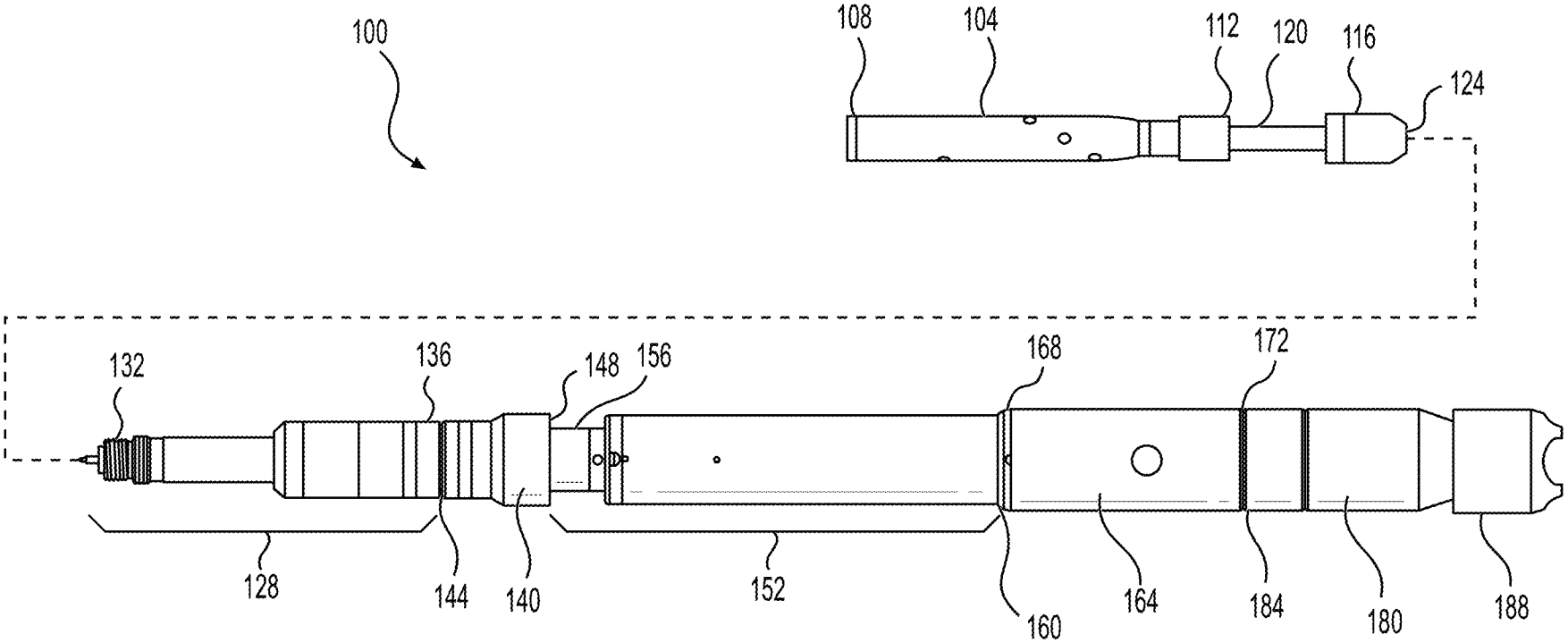
FIG. 1 is a schematic, elevation view of an illustrative embodiment of a bottom hole assembly including an illustrative embodiment of an enhanced setting tool.
Figure 2:
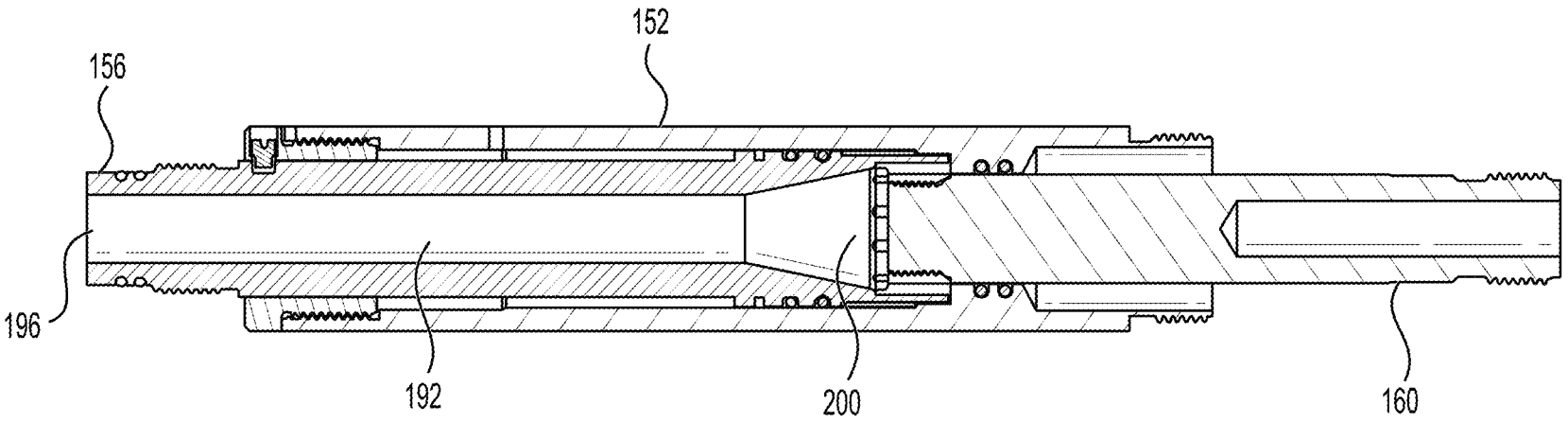
FIG. 2 is a schematic, cross-sectional view of an illustrative embodiment of an enhanced setting tool.

Referring now primarily to FIGS. 1 and 2, context is provided for understanding subsequent embodiments with improvements. With references initially to FIG. 1, a bottom hole assembly (BHA) 100 is shown. The upper most component of the bottom hole assembly 100 as shown is a perforating gun 104 having an upper end 108 (or first end) and a lower end 112 (or second end). The perforating gun 104 is followed by an adapter 116 having an upper end 120 (or first end) and a lower end (or second end) 124. The upper end 120 of the adapter 116 couples with the lower end 112 of the perforating gun 104. A quick change 128 may follow next. The quick change 128 has an upper end 132 (or first end) and a lower end 136 (or second end).

Coupled to the quick change 128 is a firing head 140, which has an upper end 144 (or first end) and a lower end 148 (or second end). Next, an illustrative embodiment of a setting tool 152, e.g., a gas-operated setting tool, follows. The setting tool 152 has an upper end 156 (or first end) and a lower end 160 (or second end). The setting tool 152 is coupled to a running gear 164 (or adapter), which has an upper end 168 (or first end) and a lower end 172 (or second end). The running gear 164 is coupled to an illustrative plug 180, e.g., a fracking plug or bridge plug or another downhole plug. The plug 180 has an upper end 184 (or first end) and a lower end 188 (or second end).

In this embodiment, the firing head 140 is coupled to the setting tool 152 to provide ignition thereto when desired. With references now primarily to FIG. 2, the setting tool 152 of some older designs did not involve pressure bulkheads as described in other embodiments herein. The setting tool 152 includes an interior combustion chamber 192 having a first end 196 and a second end 200. Note that the first end 196 is open and then is at least partially sealed by the application of components to the upper end 156 of the setting tool 152. For example, in FIG. 1, the firing head 140 form part of the partial seal. In one example, a go-style igniter, O74, is used as an igniter in a firing head, with as much as 30-40% extra volume above the combustion chamber being pressurized by the resultant gases. With this arrangement, in some instances, the pressurized gas going into the components above the setting tool 152 would cause damage to some components.

In addition, this arrangement presents difficulties because a manufacturer of a setting tool 152 like that in FIGS. 1 and 2 would not necessarily know how much volume was being added to the "effective combustion chamber" by the addition of the components above the setting tool. The amount of volume that the pressurized gas from the power charge might flow into was not fixed and could greatly impact the level of pressure generated. So, at times, this might mean the power charge in the interior combustion chamber 192 of the setting tool 152 was less powerful than desired given the volume involved. Effective use of the setting tool 152 is dependent on sufficient internal gas pressure being created by the power charge in the combustion chamber. The amount of gas pressure that can be created is determined by the amount of volume that must be pressurized. While not limited to a specific theory, this can be explained using Boyle's Gas Law.

Boyle's Gas Law states that the pressure (P) of a given quantity of gas varies inversely with its volume (V) at constant temperature: $P_1V_1=P_2V_2$. Now consider that a current setting tool is essentially an open container before components are added. The total volume of the setting tool in its final use condition is determined by the ancillary equipment or components that are connected directly to setting tool on the upper, open side, such as the firing head 140. If this equipment has a large amount of internal volume accessible by the created gases, the power charge in the interior combustion chamber 192 may not be able to generate sufficient pressure to successfully operate the setting tool 152, including disconnecting from the plug 180. In this situation, the issue is that the volume is a variable or unknown in the equation. The embodiments of enhanced setting tools below address this issue by establishing a set, or fixed volume. A fixed volume may be established by forming a pressure bulkhead (see, e.g., 226 in FIG. 4) and pressure igniter that go into an upper end 156 of the setting tool 152. Again, in this way the volume is fixed and is known. In addition, components above the pressure bulkhead are protected from the generated gas.

Figure 3:
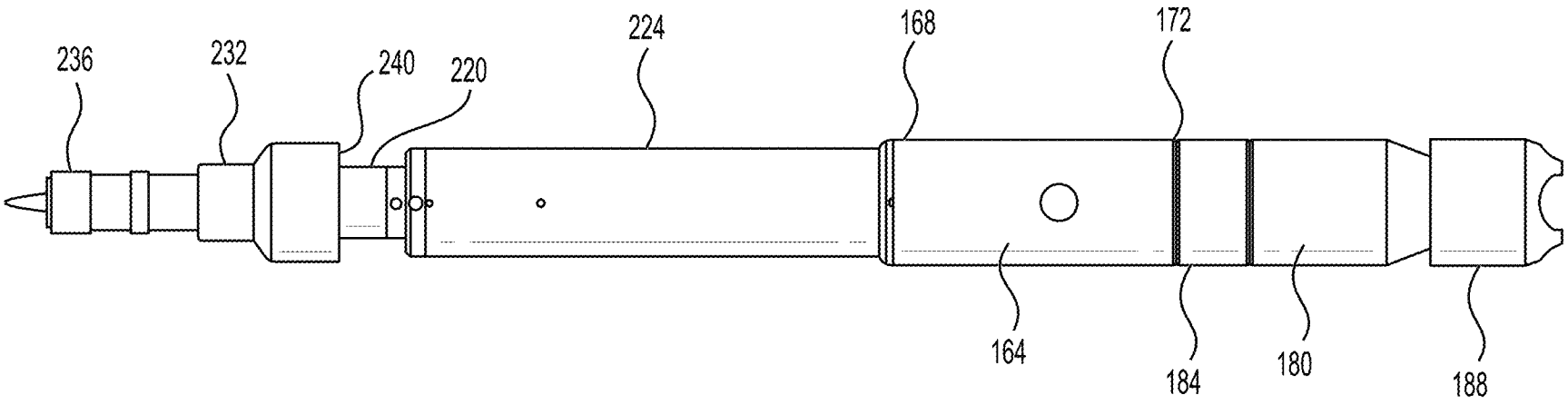
FIG. 3 is a schematic, elevation view of an illustrative embodiment of a fixed-volume setting tool.
Figure 4:
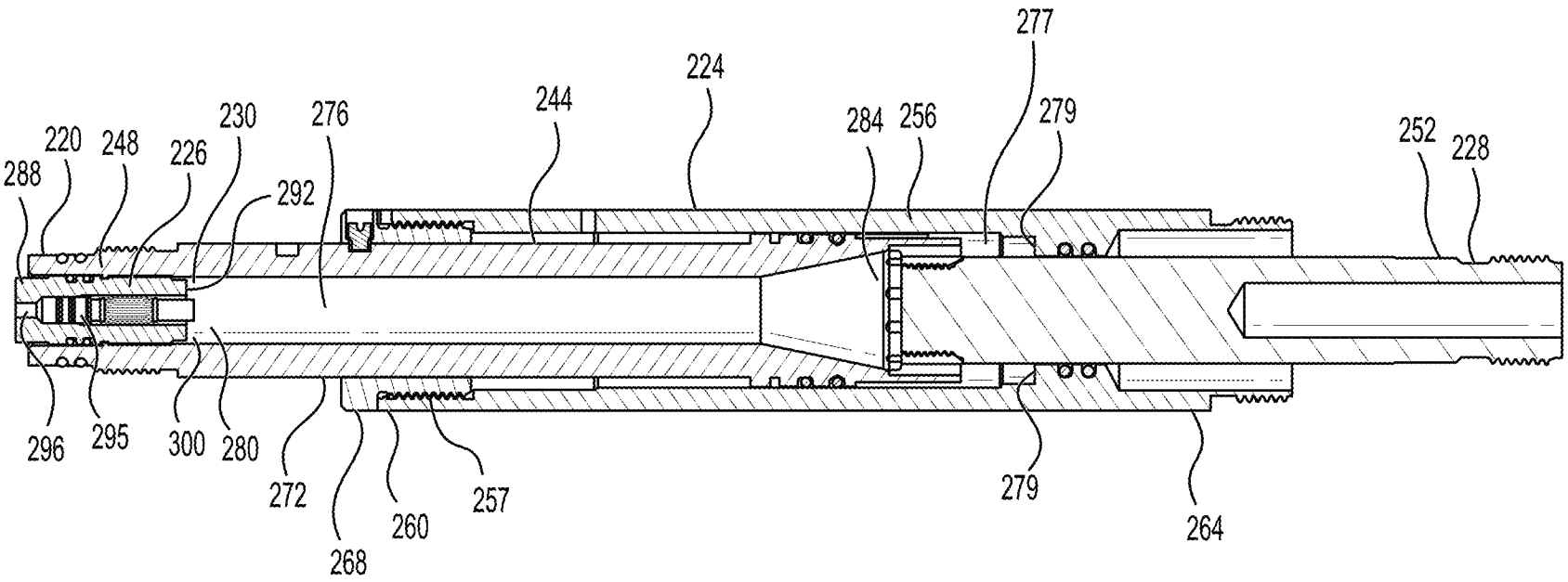
FIG. 4 is a schematic, cross sectional view of an illustrative embodiment of a fixed-volume setting tool.

With reference now primarily to FIGS. 3 and 4, an upper end 220 of a gas-operated, fixed-volume setting tool 224 receives a pressure bulkhead 226 and pressure igniter 295 that form a seal at one end of the setting tool 224 and thereby obviate the need for an external firing head (140 in FIG. 1) and create a fixed volume for the generated gases. The gas-operated, fixed-volume setting tool 224 has the upper end 220 (or first end) and a lower end 228 (or second end). A rig-up adapter 232, which has an upper end 236 (or first end) and a lower end 240 (or second end), may be applied at the upper end 220 of the gas-operated, fixed-volume setting tool 224 to couple the gas-operated, fixed-volume setting tool 224 to other components such as an adapter 116 (FIG. 1). In this embodiment, no separate firing head is used and again the volume for the generated gases is fixed. The fixed volume means the pressure generated by the power charge in the combustion chamber may be controlled to a much higher degree than otherwise would be possible.

In one illustrative embodiment, a gas-operated, fixed-volume setting tool 224 for use in oil wells includes a mandrel 244 having an upper end 248 (or first end) and lower end 252 (or second end) and a barrel piston 256 having an upper end 260 (or first end) and a lower end 264 (or second end). A retaining cap or ring 268 also goes around an exterior 272 of the mandrel 244 and is coupled to the upper end 260 of the barrel piston 256, such as buy threaded coupling 257. For purposes of this disclosure, the retaining cap or ring 268 may be regarded as a portion of the barrel piston 256.

The barrel piston 256 extends over at least a portion of the mandrel 244 when in an in-line configuration and is releasably coupled in a relative position to the mandrel 244 when in the in-line configuration. The mandrel 244 includes an interior combustion chamber 276 having an upper end 280 (or first end) proximate to the first end 248 of the mandrel 244 that is, when assembled, adjacent to the pressure bulkhead 226, and has a second end 284. The mandrel 244 has an upper interior portion 230 that is sized and configured to receive the pressure bulkhead 226, which a forms seal therein. The pressure bulkhead 226 has an upper end 288 (or first end) and a lower end 292 (or second end). The second end 292 of the pressure bulkhead 226 seals, substantially seals or helps seal the upper end 280 of the interior combustion chamber 276. The pressure bulkhead 226 can withstand high pressures while maintaining its seal. A power charge, including a secondary pellet, may be included in the combustion chamber 276 for selectively igniting when the pressurized gases are desired.

As those skilled in the art will appreciate, the pressurized gases are directed from the combustion chamber 276 to a desired location to accomplish some desired work downhole. The expanding gas escapes a lower portion of the upper mandrel 244, proximate the lower end 284 of chamber 276, into an expansion chamber 277. The increasing pressure pushes on the piston face 279 of the barrel 256, causing the barrel 256 to move downward and "set the plug" or accomplish the desired work.

The gas-operated, fixed-volume setting tool 224 includes the pressure bulkhead 226 disposed in the mandrel 244 at the upper end 248 of the mandrel 244 that seals or helps to seal the upper end 280 of the interior combustion chamber 276. The pressure igniter 295 is coupled in the pressure bulkhead 226. The pressure igniter 295 includes an ignition control end 296 (or upper or first end) and an ignition distribution end 300 (or lower end or second end). The pressure igniter 295 performs a sealing function at least until reaching at least a first threshold pressure (e.g., 20,000; 25,000; 30,000 PSI or another pressure). Thus, the pressure bulkhead 226 together with the pressure igniter 295 form a seal on the upper end 280 of the combustion chamber 276 and thereby define a fixed volume to the combustion chamber 276. The fixed volume allows the power charge to be selected or configured for the known, fixed volume to generate the desired pressure.

Figure 5:
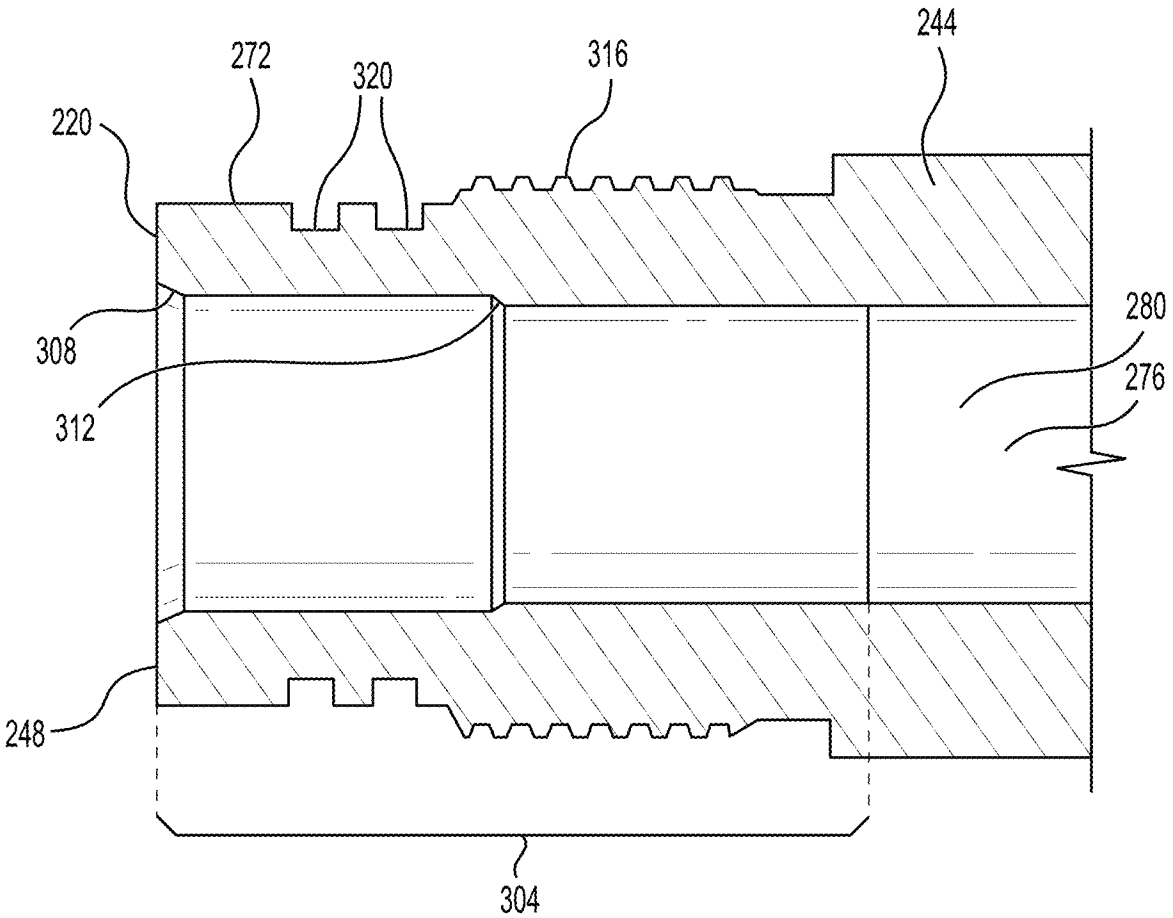
FIG. 5 is a schematic, cross sectional view of an upper end of a mandrel of an illustrative embodiment of a fixed-volume setting tool.
Figure 6:
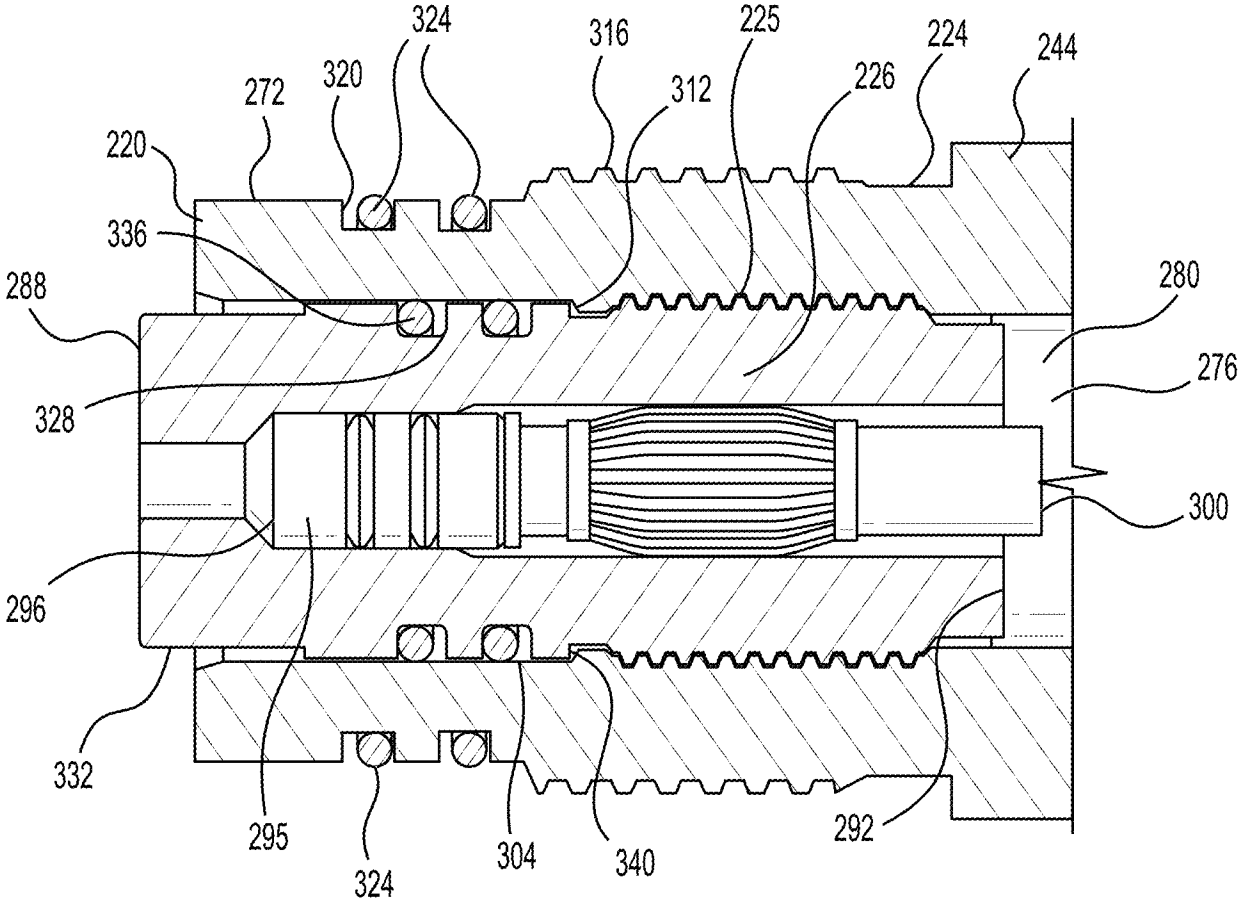
FIG. 6 is a schematic, cross sectional view of an upper end of a fixed-volume setting tool showing an illustrative embodiment of a pressure bulkhead in an assembled position.

Referring now primarily to FIG. 5, a portion of the upper end 248 of the mandrel 244 is shown. This cross section shows the shape of the upper end 248 of the mandrel 244 leading to the upper end 280 of the interior combustion chamber 276. The mandrel 244 has a chamber extension 304 forming an additional aspect of the internal chamber or a cylinder-like area into which the pressure bulkhead 226 (FIG. 4) is disposed and seals. The chamber extension 304 has a first shoulder 308 and a second shoulder 312 that aid in receiving and coupling the pressure bulkhead 226. This illustrative design allows the gas-operated, fixed-volume setting tool 224 to be used with the pressure bulkhead 226 and pressure igniter 295 (FIG. 4) or alternatively without, i.e., backward compatible. That decision can be made in the field. If used without, the second end 148 of the firing head 140 (FIG. 1) goes over the exterior 272 and mates with threads 316 (or an attachment member) on the exterior 272 of the mandrel 244. One or more seal grooves 320 are formed on the exterior 272 of the mandrel 244 near the upper end 248 for receiving O-rings 324 (FIG. 6). If the pressure bulkhead 226 is used, it is inserted into the mandrel 244 as shown in FIG. 6.

Referring now primarily to FIG. 6, this cross section shows the pressure bulkhead 226 positioned within the chamber extension 304 of the mandrel 244 with the pressure igniter 295 disposed within the pressure bulkhead 226. In this way, the upper end 280 of the interior combustion chamber 276 is sealed and the volume of the interior combustion chamber 276 is fixed. As such, the desired power charge disposed in the combustion chamber 276 for proper operation of the setting tool 152 can be predicted and placed in the interior combustion chamber 276.

In addition, this approach eliminates the need for the separate firing head 140 (FIG. 1) and thereby eliminates a number of seals that would otherwise be exposed to harsh conditions inside the casing. Note that one or more seal grooves 328 are formed on the exterior 332 of the pressure bulkhead 226 for receiving O-rings 336, which are not subjected to as harsh of condition as O-rings 324 in second grooves 320. The pressure bulkhead 226 may have a shoulder 340 on its exterior 332 that interfaces with the second shoulder 312 of the mandrel 244. The pressure bulkhead 226 may be held, at least in part, within the upper mandrel by a threaded connection 225.

Figure 7:
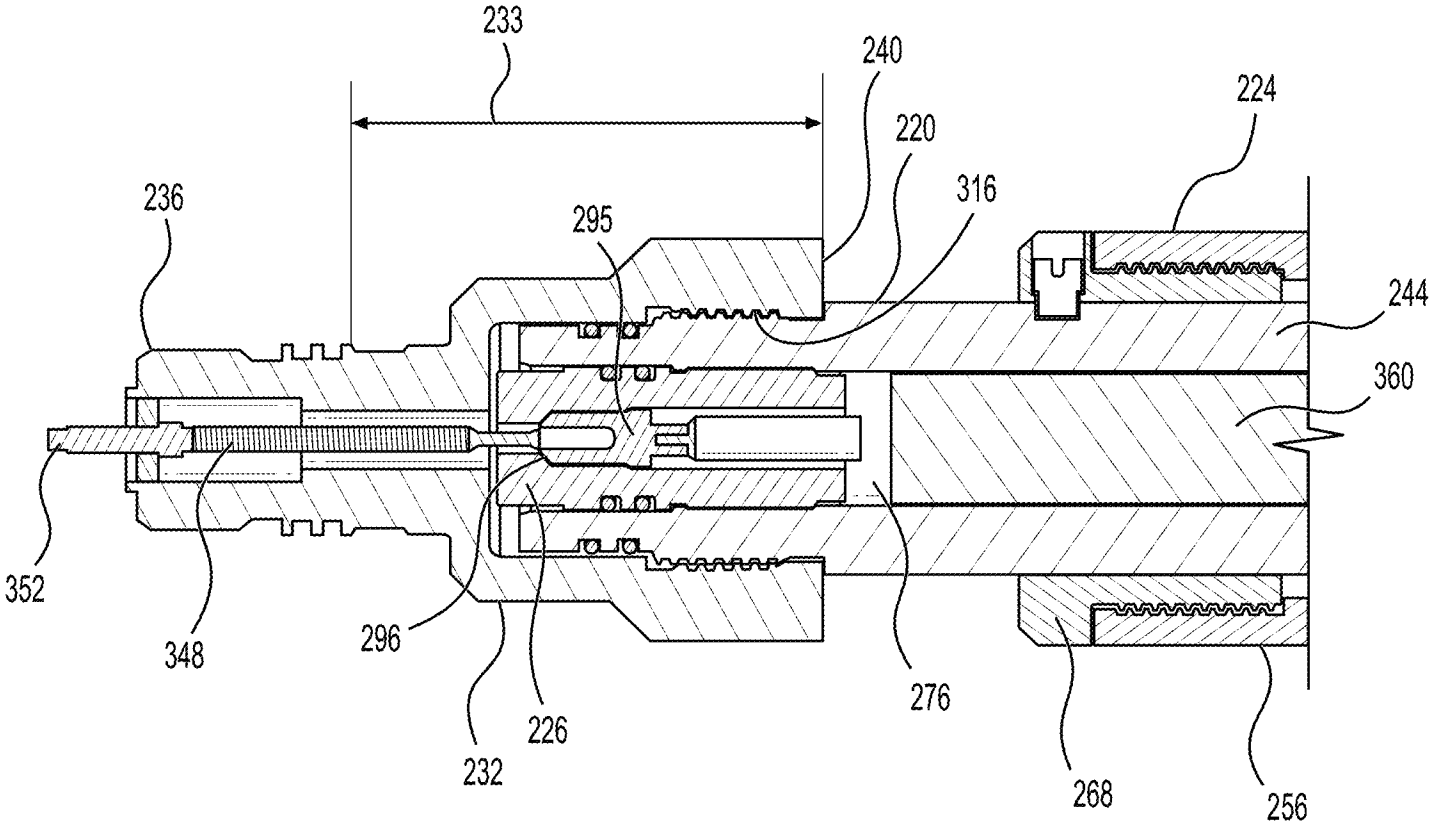
FIG. 7 is a schematic, elevation view of an illustrative embodiment of an upper end of a fixed-volume setting tool.

Referring now primarily to FIG. 7, in an illustrative embodiment, the upper end 220 of the gas-operated, fixed-volume setting tool 224 is shown with rig-up adapter 232 coupled directly thereto. Since the igniter 295 is included in the pressure bulkhead, there is no need for a separate firing head. In this way, in the bottom hole assembly developed in this way, the firing head 140 may be eliminated. This eliminates a number of O-rings, which increases reliability, and shortens the length of the bottom hole assembly. Note also that the inclusion of the igniter in the pressure bulkhead facilitates recycling of the igniter after the pressure bulkhead is removed.

The rig-up adapter 232 has the upper end 236 and a lower end 240. The rig-up adapter 232 is sized and configured at the lower end 240 of the rig-up adapter 232 to at least partially surround the upper end 220 of the gas-operated, fixed volume setting tool 224 and couple to the threads 316 on the exterior 272 of the upper end 220 of the gas-operated, fixed-volume setting tool 224. The upper end 236 of the rig-up adapter 232 is sized and configured to extend into and mate with the lower end of the fracturing gun 104 (FIG. 1) or the adapter 116 and couple thereto. An electrical coupler 348 is shown going from the ignition control end 296 of the pressure igniter 295 to a fitting 352. The electrical coupler 348 may take different configuration for different pressure requirements or applications, e.g., high-pressure electrical feed throughs, gold-plated electrical pins, white body piece, rubber boot, etc. A power charge 360 is shown in the interior combustion chamber 276. While not explicitly shown, the power charge 360 may also include a secondary pellet. In one illustrative embodiment, dimension 233 is 4.38 inches, but other dimensions many be used as those skilled in the art will appreciate.

Figure 8:
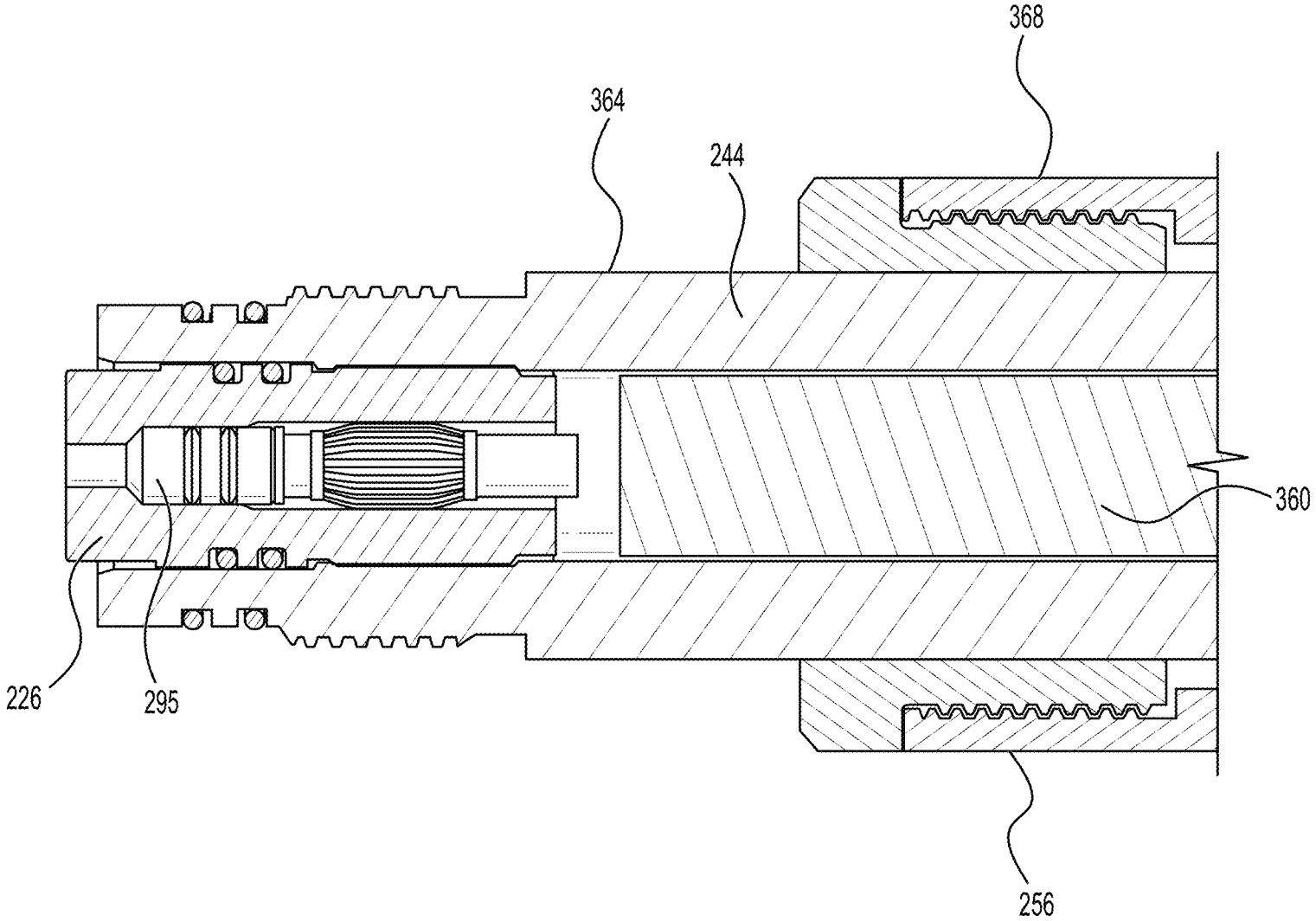
FIG. 8 is a schematic, cross sectional view of an illustrative embodiment of an upper end of a fixed-volume setting tool configured to mate directly with a fracturing gun with the use of a coupler.

Referring now primarily to FIG. 8, an upper end 364 of another illustrative embodiment of a gas-operated, fixed-volume setting tool 368 is presented. The setting tool 368 is analogous to the setting tool 224 except the upper end 364 has been modified to allow the upper end 364 to couple directly to the lower end 112 of the perforating gun 104 (FIG. 1). Comparing to FIG. 1, the firing head 140 and quick change 128 are omitted. Instead of quick change or firing head, only a coupler is used.

The omission of the quick change 128 is made possible by the setting tool design being more compact and light. The quick change is a component that is useful with traditional bottom hole assemblies when connecting tools to a gunstring. A gunstring is often 40 to 60 feet long and weighs several 100 pounds. A quick change has a collar that allows the inner mandrel to be turned during makeup without having to turn either the gunstring or the tool being connected to the gunstring. The traditional, older tools are often as much as eight feet in length and weigh hundreds of pounds. As such, that is cumbersome to try and spin while making up the threaded connection, and so often a quick change is utilized. With at least some embodiments of setting tools of the present disclosure, the setting tool is only about 3 feet long and weighs only around 50 pounds. Thus, the free spinning feature of a quick change is no longer necessary, and the quick change may be eliminated.

In addition to the examples given, many other examples may be provided. Additional examples follow.

Example 1. A gas-operated fixed-volume setting tool for use in oil wells comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and a second end proximate to the second end of the mandrel;

a pressure bulkhead disposed in the mandrel at the first end of the mandrel and sealing the first end of the interior combustion chamber; and a pressure igniter coupled in the pressure bulkhead having an ignition control end and an ignition distribution end, wherein the pressure igniter is sealed to at least a first threshold pressure, whereby the pressure bulkhead and pressure igniter form a seal on the first end of the combustion chamber and thereby defines a fixed volume to the combustion chamber.

Example 2. The gas-operated fixed-volume setting tool of Example 1, wherein an exterior of the first end of the upper portion of the mandrel is configured to receive and mate with a firing head when the pressure bulkhead and igniter are omitted.

Example 3. A bottom hole assembly comprising:

a fracturing gun for perforating, wherein the fracturing gun includes an upper end and a lower end;

a setting tool having an upper end and a lower end, and wherein the upper end includes threads formed on an exterior surface;

wherein the setting tool comprises:

a mandrel having an upper portion and a lower portion, a barrel piston having a first end and a second end, and wherein the barrel piston extends over at least a portion of the mandrel when in an in-line configuration and releasably coupled in a relative position to the mandrel when in the in-line configuration, wherein the mandrel has a first end on the upper portion of the mandrel and a second end on the lower portion of the mandrel, wherein the mandrel includes an interior combustion chamber having a first end proximate to the first end of the mandrel and a second end proximate to the second end of the mandrel, a pressure bulkhead disposed in the mandrel at the first end of the mandrel and sealing the first end of the interior combustion chamber, and a pressure igniter coupled in the pressure bulkhead having an ignition control end and an ignition distribution end, wherein the pressure igniter is sealed to at least a first threshold pressure, whereby the pressure bulkhead and pressure igniter form a seal on the first end of the combustion chamber and thereby defines a fixed volume to the combustion chamber;

a rig-up adapter having an upper end and a lower end, the rig-up adapter sized and configured at the lower end of the rig-up adapter to at least partially surround the upper end of the setting tool and coupled to the threads on the exterior of the upper end of the setting tool; and wherein the upper end of the rig-up adapter is sized and configured to extend into and mate with the lower end of the fracturing gun or another adapter and couple thereto.

Example 4. A bottom hole assembly comprising:

a fracturing gun for perforating, wherein the fracturing gun includes an upper end and a lower end, wherein the lower end includes a first attachment member;

a setting tool having an upper end and a lower end, and wherein in the upper end includes a second attachment member sized and configured to mate and couple with the first attachment member of the fracturing gun; and wherein the setting tool comprises:

a mandrel having an upper portion and a lower portion, a barrel piston having a first end and a second end, and wherein the barrel piston extends over at least a portion of the mandrel when in an in-line configuration and releasably coupled in a relative position to the mandrel when in the in-line configuration, wherein the mandrel has a first end on the upper portion of the mandrel and a second end on the lower portion of the mandrel, wherein the mandrel includes an interior combustion chamber having a first end proximate the first end of the mandrel and second end proximate the second end of the mandrel, a pressure bulkhead disposed in the mandrel at the first end of the mandrel and sealing the first end of the interior combustion chamber, and a pressure igniter coupled in the pressure bulkhead having an ignition control end and an ignition distribution end, the pressure igniter is sealed to at least a first threshold pressure, whereby the pressure bulkhead and pressure igniter form a seal on the first end of the combustion chamber and thereby defines a fixed volume to the combustion chamber.

Example 5. The bottom hole assembly of Example 4, wherein the upper end of the setting tool is coupled to the lower end of the fracturing gun by the first attachment member and second attachment member.

Figure 9:
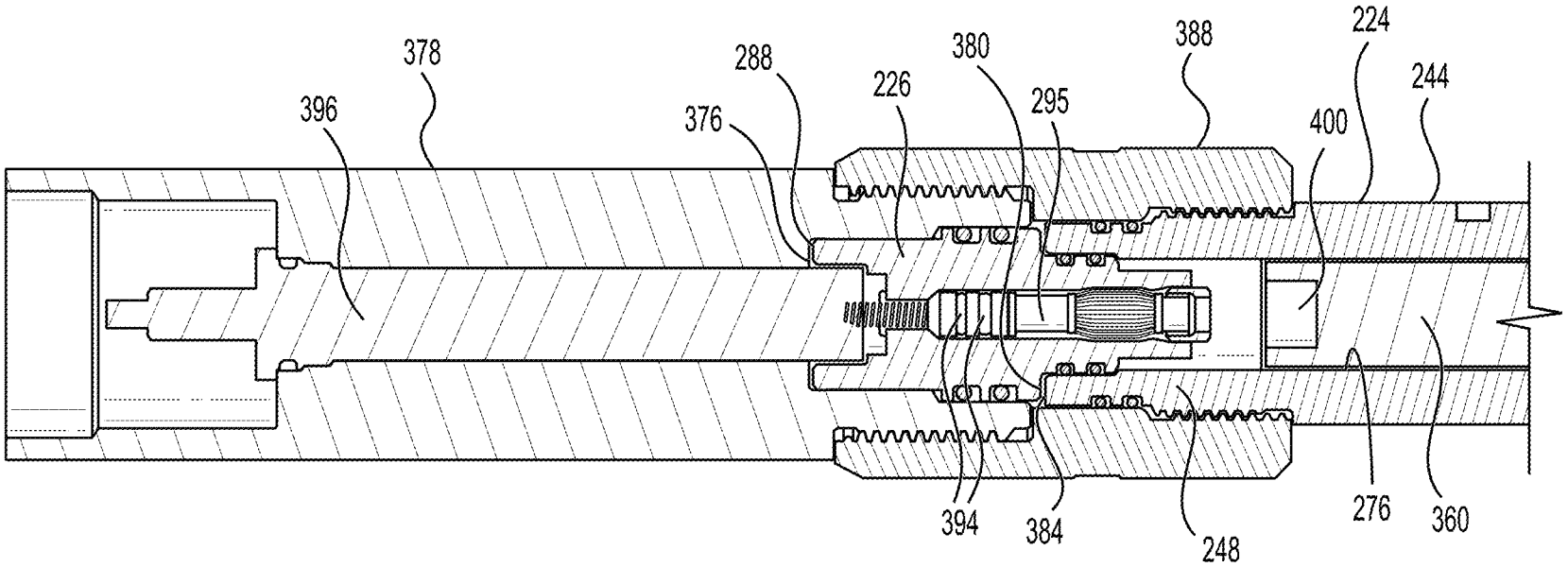
FIG. 9 is a schematic, elevation view of an illustrative embodiment of an upper end of a fixed-volume setting tool.

Referring now primarily to FIG. 9, another illustrative embodiment of a gas-operated fixed-volume setting tool 224 is presented. This figure shows that in some embodiments, the pressure bulkhead 226 is held in place without any threaded couplers, but other embodiments may include threaded couplers.

The pressure bulkhead 226 with pressure igniter 295 (not in cross section) couples to an upper end 220 of the setting tool 224; they replace the igniter, igniter holder, and other components that were above the tool and allow a seal to be formed at the upper end 220. The upper end 288 of the pressure bulkhead 226, when in an installed position, abuts shoulder 376 on an upstream component 378. When in the installed position, a shoulder 380 of the pressure bulkhead 226 abuts an end 384 of the mandrel 244. A threaded coupling sleeve 388 may be used to couple a lower end 390 of component 378 and the upper end 248 of the mandrel 244. In this way, one may see that the pressure bulkhead 226 with pressure igniter 295 are held in place without a threaded coupling. The resultant pressure from the combustion chamber 276 stops at one or more seals 394 of the pressure igniter 295. Without this arrangement, pressure would go all the way up the plug and shoot cartridge 396.

As those skilled in the art will appreciate a wireline is electrically coupled to the igniter 295 for initiating the same. The igniter 295 will initiate a burn of the secondary pellet 400 associated with or forming part of the power charge 360 to generate the pressurized gases.

Figure 10:
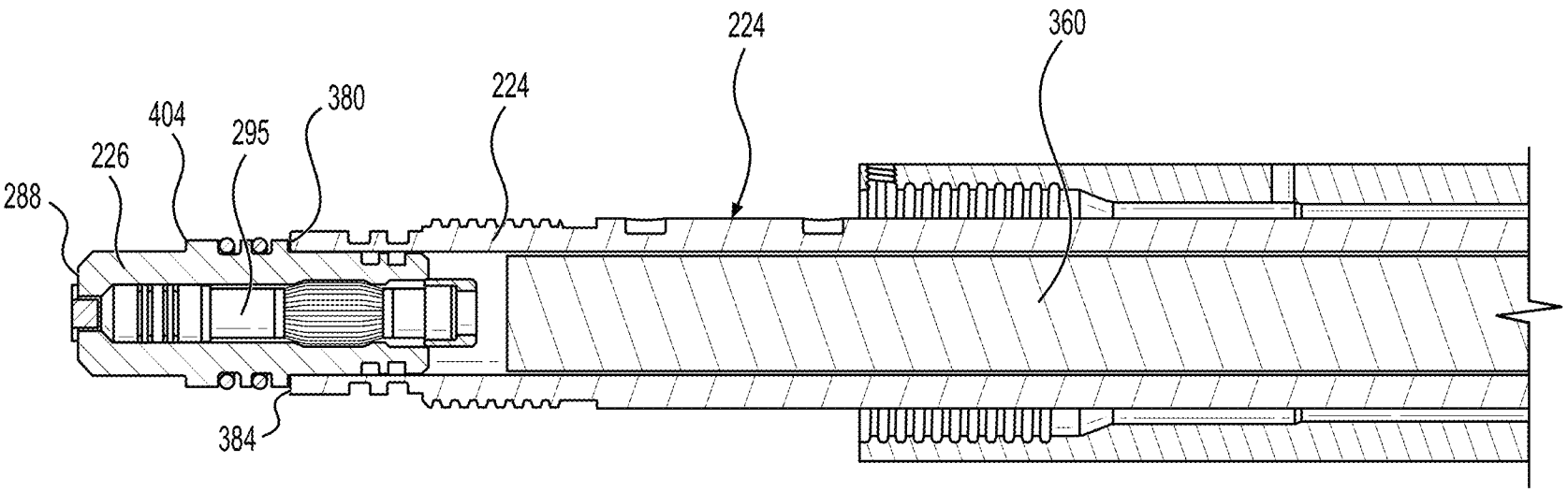
FIG. 10 is a schematic, elevation view of an illustrative embodiment of an upper end of a fixed-volume setting tool.

Referring now primarily to FIG. 10, another illustrative embodiment of a gas-operated fixed-volume setting tool 224 is presented. The setting tool 224 is analogous in most respects to those previously presented. The pressure bulkhead 226 is inserted into a mandrel 244 and again the pressure bulkhead 226 with igniter 295 is held in place by being sandwiched between coupled components and with shoulder 380 against end 384 and with a shoulder 404 abutting another shoulder (by analogy see shoulder 376 against end 288 in FIG. 9). The shoulder 404 is a pressure containment shoulder. An adapter or coupling sleeve (see, e.g., 388 in FIG. 9) screws on holds the pressure bulkhead in place in conjunction with the mentioned shoulders. Note the different shape to the pressure bulkhead by comparing FIGS. 9 and 10.

Figure 11:
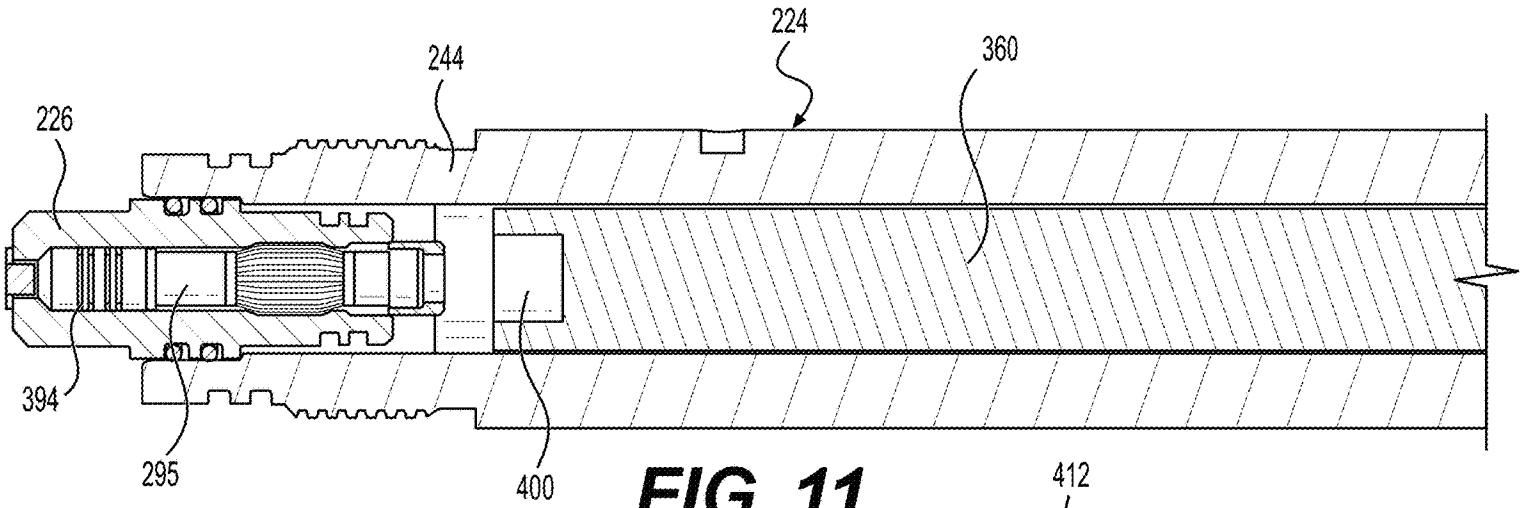
FIG. 11 is a schematic, elevation view of an illustrative embodiment of an upper end of a fixed-volume setting tool.

Referring now primarily to FIG. 11, another illustrative embodiment of a gas-operated fixed-volume setting tool 224 is presented. This embodiment is analogous in most respects with the embodiment shown in FIG. 4.

Figure 12:
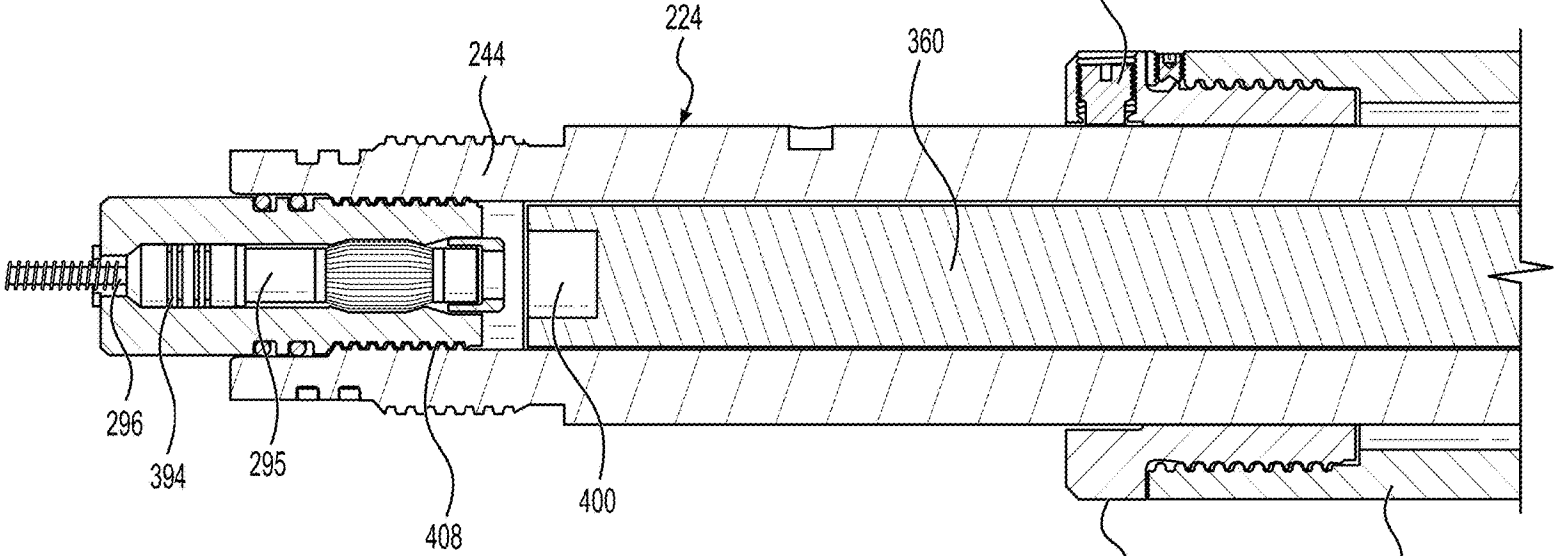
FIG. 12 is a schematic, elevation view of an illustrative embodiment of an upper end of a fixed-volume setting tool.

Referring now primarily to FIG. 12, another illustrative embodiment of a gas-operated fixed-volume setting tool 224 is presented. This embodiment is analogous in most respects to those previously presented, but includes a threaded coupling 408 between the pressure bulkhead 226 and an interior portion of the mandrel 244. A sheer pin 412 may be used to hold the relative position of the barrel piston 256 and the mandrel 224 until an adequate sheer stress is applied.

Figure 13:
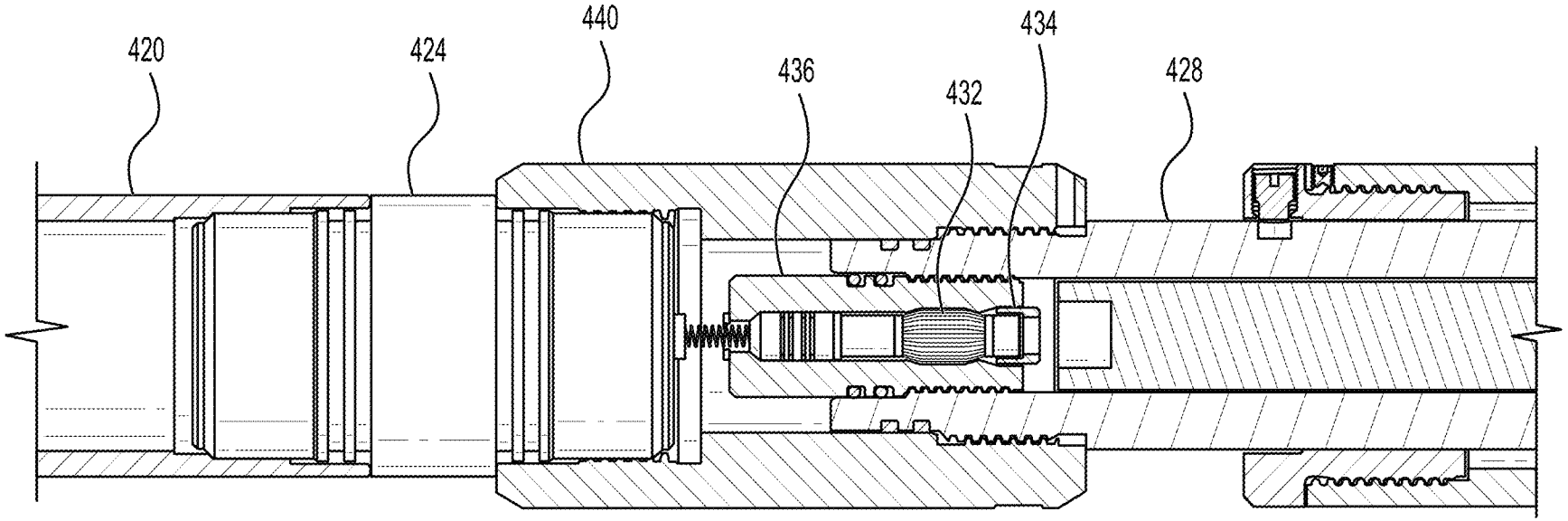
FIG. 13 is a is a schematic, cross sectional view of an illustrative embodiment of an upper end of a fixed-volume setting tool configured to mate with a fracturing gun with the use of an adapter.

Referring now primarily to FIG. 13, in one illustrative embodiment, a portion of the downhole assembly proceeds from the perforating gun 420 to a tandem sub 424 to the setting tool 428. The setting tool 428 includes a bulkhead igniter 432 with an internal disposable firing head 436 as previously presented. On an exterior of the lower end of the tandem sub and on the upper end of the setting tool is a reusable adapter 440. In this configuration the reusable adapter 440 does not require any O-rings. The adapter 440 interfaces with exterior threads on the tandem sub 424 and exterior threads on the upper end of the setting tool 428. The upper end of the reusable adapter 440 may interface with a shoulder on the lower end of the tandem sub and a shoulder on the lower end of the reusable adapter 440 may interface with a shoulder on the upper end of a mandrel of the setting tool 428. The pressure bulkhead igniter 432 is held at one end by a retainer 434, which keeps the pressure igniter from falling out. The inside of the retainer 434 is threaded and mates with the end of the pressure bulkhead igniter 432.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment. Note that while "fixed-volume" is used herein, one should appreciate that some variation may be possible without departing from the scope of the disclosure; the ratio of power charge mix to free volume is maintained within 5%, 10%, or another percentage. Those skilled in the art will appreciate that variations of this type may be made.

What is claimed:

1. A gas-operated, fixed-volume, downhole setting tool comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and having an interior upper portion;

a pressure bulkhead disposed in the mandrel at the first end of the mandrel in the interior upper portion of the mandrel;

a pressure igniter coupled in the pressure bulkhead having an ignition control end and an ignition distribution end;

wherein the pressure igniter is sealed to at least a first threshold pressure;

wherein the pressure bulkhead and pressure igniter form a seal on the first end of the mandrel and thereby define a fixed volume for combustion gases; and wherein the pressure igniter is not directly coupled to any component that is in contact with the mandrel other than the pressure bulkhead.

2. The gas-operated, fixed-volume, downhole setting tool of claim 1, wherein the pressure bulkhead and pressure igniter form an integral bulkhead igniter.

3. The gas-operated, fixed-volume, downhole setting tool of claim 1, wherein the upper portion of the mandrel is sized and configured to mate and couple with an uphole component.

4. The gas-operated, fixed-volume, downhole setting tool of claim 3, wherein the upper portion of the mandrel is sized and configured to mate and couple with an uphole component using a threaded connection; and wherein the threaded connection comprises threads on an exterior surface of the mandrel.

5. The gas-operated, fixed-volume, downhole setting tool of claim 3, wherein the uphole component is an adapter.

6. The gas-operated, fixed-volume, downhole setting tool of claim 1, wherein the mandrel includes one or more shoulders on the upper interior portion;

wherein an exterior of the pressure bulkhead includes one or more shoulders sized and configured to abut the one or more shoulders of the mandrel on the upper interior portion; and wherein the pressure bulkhead comprises a plurality of seal groves and a plurality of seals in the plurality of seal grooves.

7. A gas-operated, fixed-volume, downhole setting tool comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and having an interior upper portion;

a pressure bulkhead disposed in the mandrel at the first end of the mandrel in the interior upper portion of the mandrel;

a pressure igniter coupled in the pressure bulkhead having an ignition control end and an ignition distribution end;

wherein the pressure igniter is sealed to at least a first threshold pressure;

wherein the pressure bulkhead and pressure igniter form a seal on the first end of the mandrel and thereby define a fixed volume for combustion gases; and wherein the pressure igniter ignition distribution end is supported in place by only the coupling between the pressure igniter and the pressure bulkhead.

8. The gas-operated, fixed-volume, downhole setting tool of claim 7, wherein the pressure bulkhead and pressure igniter form an integral bulkhead igniter.

9. The gas-operated, fixed-volume, downhole setting tool of claim 7, wherein the upper portion of the mandrel is sized and configured to mate and couple with an uphole component.

10. The gas-operated, fixed-volume, downhole setting tool of claim 9, wherein the uphole component is an adapter.

11. The gas-operated, fixed-volume, downhole setting tool of claim 7, wherein the upper portion of the mandrel is sized and configured to mate and couple with an uphole component using a threaded connection; and wherein the threaded connection comprises threads on an exterior surface of the mandrel.

12. The gas-operated, fixed-volume, downhole setting tool of claim 7, wherein the mandrel includes one or more shoulders on the upper interior portion;

wherein an exterior of the pressure bulkhead includes one or more shoulders sized and configured to abut the one or more shoulders of the mandrel on the upper interior portion; and wherein the pressure bulkhead comprises a plurality of seal groves and a plurality of seals in the plurality of seal grooves.

13. A gas-operated, fixed-volume, downhole setting tool comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and having an interior upper portion;

a pressure bulkhead disposed in the mandrel at the first end of the mandrel in the interior upper portion of the mandrel;

a pressure igniter coupled in the pressure bulkhead having an ignition control end and an ignition distribution end;

wherein the pressure igniter is sealed to at least a first threshold pressure;

wherein the pressure bulkhead and pressure igniter form a seal on the first end of the mandrel and thereby define a fixed volume for combustion gases; and wherein the pressure igniter is not coupled to a holder in contact with the mandrel other than the pressure bulkhead.

14. The gas-operated, fixed-volume, downhole setting tool of claim 13, wherein the pressure bulkhead and pressure igniter form an integral bulkhead igniter.

15. The gas-operated, fixed-volume, downhole setting tool of claim 13, wherein the upper portion of the mandrel is sized and configured to mate and couple with an uphole component.

16. The gas-operated, fixed-volume, downhole setting tool of claim 15, wherein the uphole component is an adapter.

17. The gas-operated, fixed-volume, downhole setting tool of claim 13, wherein the upper portion of the mandrel is sized and configured to mate and couple with an uphole component using a threaded connection; and wherein the threaded connection comprises threads on an exterior surface of the mandrel.

18. The gas-operated, fixed-volume, downhole setting tool of claim 13, wherein the mandrel includes one or more shoulders on the upper interior portion;

wherein an exterior of the pressure bulkhead includes one or more shoulders sized and configured to abut the one or more shoulders of the mandrel on the upper interior portion; and wherein the pressure bulkhead comprises a plurality of seal groves and a plurality of seals in the plurality of seal grooves.

19. A gas-operated, fixed-volume, downhole setting tool comprising:

a mandrel having an upper portion and a lower portion;

a barrel piston having a first end and a second end, and wherein the barrel piston extends over at least a portion of the mandrel when in an in-line configuration and releasably coupled in a relative position to the mandrel when in the in-line configuration;

wherein the mandrel has a first end on the upper portion and a second end on the lower portion;

wherein the mandrel includes an interior combustion chamber having a first end proximate to the first end of the mandrel and having an interior upper portion;

a pressure bulkhead disposed in the mandrel at the first end of the mandrel in the interior upper portion of the mandrel; and wherein an exterior of the first end of the upper portion of the mandrel is configured to receive and mate with a firing head.

* * * * *